United States Patent [19]

Stahlecker

[11] Patent Number: 4,617,792

[45] **Date of Patent: * Oct. 21, 1986**

[54] AIR FLOW CONTROL ARRANGEMENT FOR AN OPEN-END FRICTION SPINNING MACHINE

[75] Inventor: Fritz Stahlecker, Josef-Neidhart-Strasse 18, 7347 Bad Überkingen, Fed. Rep. of Germany

[73] Assignees: Hans Stahlecker; Fritz Stahlecker, both of Fed. Rep. of Germany

[ * ] Notice: The portion of the term of this patent subsequent to May 7, 2002 has been disclaimed.

[21] Appl. No.: 677,367

[22] Filed: Dec. 3, 1984

[30] Foreign Application Priority Data

Dec. 3, 1983 [DE] Fed. Rep. of Germany ..... 3343762

[51] Int. Cl.[4] ..... D01H 7/885; D01H 11/00

[52] U.S. Cl. ..... 57/401; 57/301; 57/302; 57/304; 57/411

[58] Field of Search ..... 57/300, 301, 304, 400, 57/401, 302, 404, 406, 408, 411, 412, 413

[56] References Cited

U.S. PATENT DOCUMENTS

| | | | |
|---|---|---|---|
| 4,154,052 | 5/1979 | Alston | 57/302 |
| 4,159,620 | 7/1979 | LaFlaquiere et al. | 57/301 |
| 4,380,892 | 4/1963 | Parker et al. | 57/263 X |
| 4,399,650 | 8/1983 | Parker et al. | 57/401 X |
| 4,514,972 | 5/1985 | Stahlecker | 57/301 |

*Primary Examiner*—Donald Watkins

*Attorney, Agent, or Firm*—Barnes & Thornburg

[57] ABSTRACT

In the case of a friction spinning machine having at least one spinning unit containing two friction rollers that are arranged next to one another to form a wedge-shaped yarn forming gap serving as the yarn forming zone, it is provided that in the area located opposite the yarn forming point the friction rollers are covered by a housing side and that by means of periodically switchable means, an air flow is produced between the housing side and the rollers.

23 Claims, 3 Drawing Figures

AIR FLOW CONTROL ARRANGEMENT FOR AN OPEN-END FRICTION SPINNING MACHINE

BACKGROUND AND SUMMARY OF THE INVENTION

This invention relates to an open-end friction spinning machine of the type having at least one spinning unit containing two friction rollers that are arranged next to one another to form a wedge-shaped yarn forming gap serving as the yarn forming zone and, in the area that is opposite the yarn forming zone, is covered by a housing side.

In the case of a machine for open-end friction spinning described in German Published Unexamined Application (DE-OS) No. 32 13 478, it is known to cover the area of the friction rollers that is opposite the yarn forming zone by a housing side. The purpose is to form a flow duct especially for the friction roller rotating out of the wedge-shaped gap so that the roller will further carry along single fibers carried out of the wedge-shaped gap and return them to the wedge-shaped gap. Since in the case of this machine, the suction draught produced within both rollers is aimed only at the area of the wedge-shaped gap, it is improbable that the fibers once carried out of the wedge-shaped gap would go the whole way around one or both rollers and return into the wedge-shaped gap. It can rather be expected that these fibers will deposit and adhere at an undefined point in the area between the housing side and the rollers. The danger then exists that these fibers and possibly other dirt may collect and are later pulled back into the yarn forming zone in an uncontrolled manner, especially during a piecing process, after which both suction devices of the rollers are switched off. The existence of such collections of fibers may result in an impairment of the piecing process and create thin or thick points. In addition, there is the danger that these collections may be wedged between the rollers or between the rollers and the housing sides which can result in damage to the drums and/or their bearings. The otherwise advantageous covering of the area of the rollers that is opposite the yarn forming zone can therefore result in practical difficulties.

The invention is based on the objective of developing an open-end friction spinning machine of the initially mentioned type in such a way that the advantages of a covering of the area opposite the yarn forming zone are achieved but that the danger of disturbances is, at the same time, eliminated.

This objective is achieved according to the invention by providing means that can be switched on periodically in order to produce an air flow/current between the housing side and the rollers.

This air flow, which is produced especially during an interruption of the spinning process can be selected in a simple manner according to preferred embodiments of the invention to be so strong that fibers or flying fibers or other dirt existing in this area are removed thereby. It is assumed that individual fibers that have "lost their way" during the normal spinning operation are not damaging so that a periodic cleaning of the area of the rollers is sufficient according to these preferred embodiments.

In a further development of the invention, it is provided that the, air flow producing means for producing the air flow between the housing side and the rollers are housed in a servicing apparatus that can be moved along the spinning machine and can be selectively applied to the individual spinning units. The means for producing the air current therefore do not have to be installed at each spinning unit. Thus manufacturing costs are reduced while it is ensured at the same time that the servicing operations carried out by the servicing apparatus are the same at each spinning unit. It is preferably provided in this case that the means for producing the air current are arranged at a servicing apparatus that carries out other functions and especially a piecing process after a yarn breakage. In this case, the cleaning of the area surrounding the rollers is then combined with a piecing process so that the original conditions are restored for the piecing.

In a further development of the invention, it is provided that the servicing apparatus is equipped with a pot-shaped screen that can be applied to the edges of the housing side within which the means for producing the air flow are arranged. This ensures that the fiber residues, or dirt or other substances detached at the respective spinning unit are removed effectively and are not deposited at another point of the spinning unit or of an adjacent spinning unit.

In the case of an advantageous embodiment of the invention, it is provided that a blowing nozzle can be applied to the gap between the edge of the housing side and a surface line of a roller and a suction nozzle can be applied to the gap between the edge of the housing side and a surface line of the other roller. As a result, a defined air flow can be achieved that flows evenly past both rollers.

In a further development of the invention, it is provided that the area of the wedge-shaped gap of the spinning unit serving as the yarn forming zone is equipped with a removable partial housing and that the servicing apparatus is equipped with means for removing the partial housing and with the means for producing the air flow. By means of this development it is ensured that the cleaning is carried out while the spinning unit is open, the essential parts being exposed by moving away the partial housing and thus being well accessible.

In a further development of the invention, it is provided that the servicing apparatus is equipped with an auxiliary drive that can be applied to the rollers of the spinning unit. It thus becomes possible to drive the rollers at an appropriate speed during the production of the air flow, if necessary, also in reversed rotational direction.

In a further development of the invention, it is provided that the servicing apparatus is equipped with at least one cleaning element that can be applied to the cover/shell surfaces of the rollers. In this way, it is possible to combine the cleaning of the surroundings of the rollers with a cleaning of the roller cover surfaces. Advantageously, a brush-type cleaning element is used according to especially preferred embodiments of the invention.

Further objects, features, and advantages of the present invention will become more apparent from the following description when taken with the accompanying drawings which show, for purposes of illustration only, embodiments constructed in accordance with the present invention.

DETAILED DESCRIPTION OF THE DRAWINGS

Figure 1:
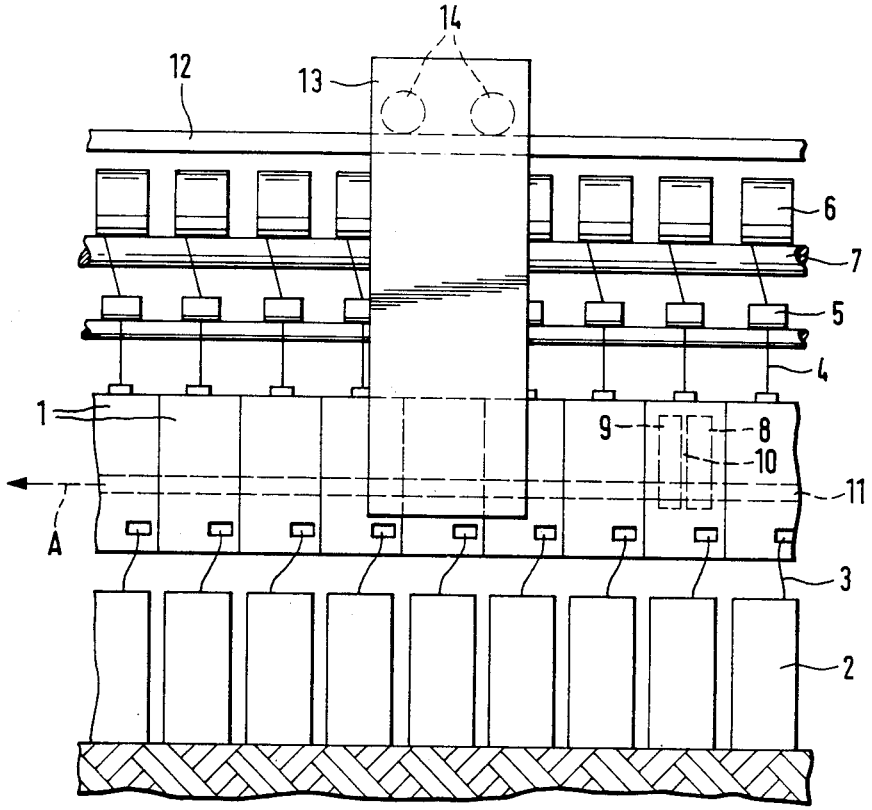
FIG. 1 is a partial front schematic view of an open-end friction spinning machine having a movable servicing apparatus, arranged in accordance with preferred embodiments of the present invention.

The open-end friction spinning machine according to FIG. 1 has a plurality of similiarly constructed spinning units 1 which are arranged next to one another in a row. A sliver 3 is fed to each spinning unit 1 from a can 2, said sliver 3 being spun into a yarn 4 that is withdrawn by a withdrawal device 5 and is fed to a wind-up spool 6 driven by a driving roller 7.

Figure 2:
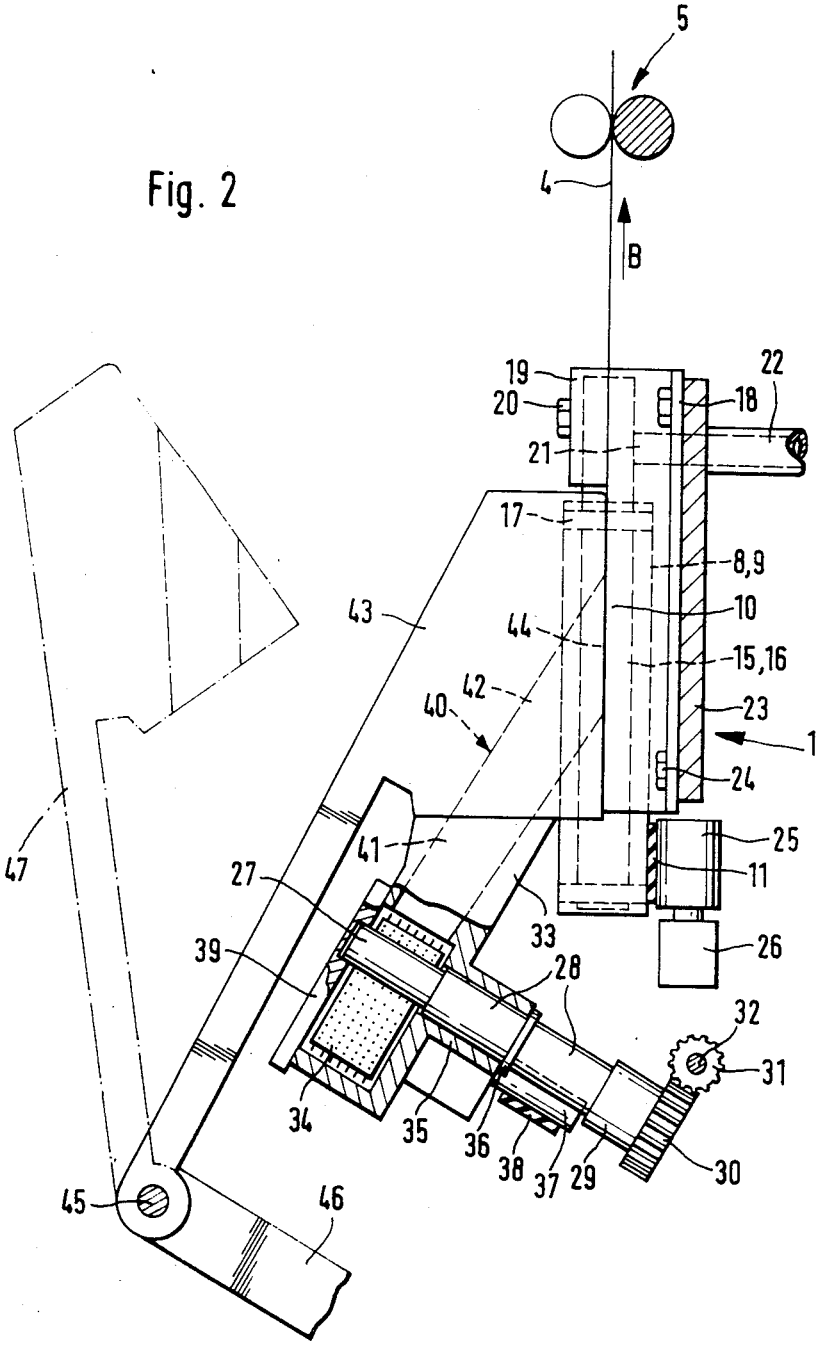
FIG. 2 is an enlarged vertical sectional schematic view through the open-end friction spinning machine of FIG. 1 in the area of a spinning unit.
Figure 3:
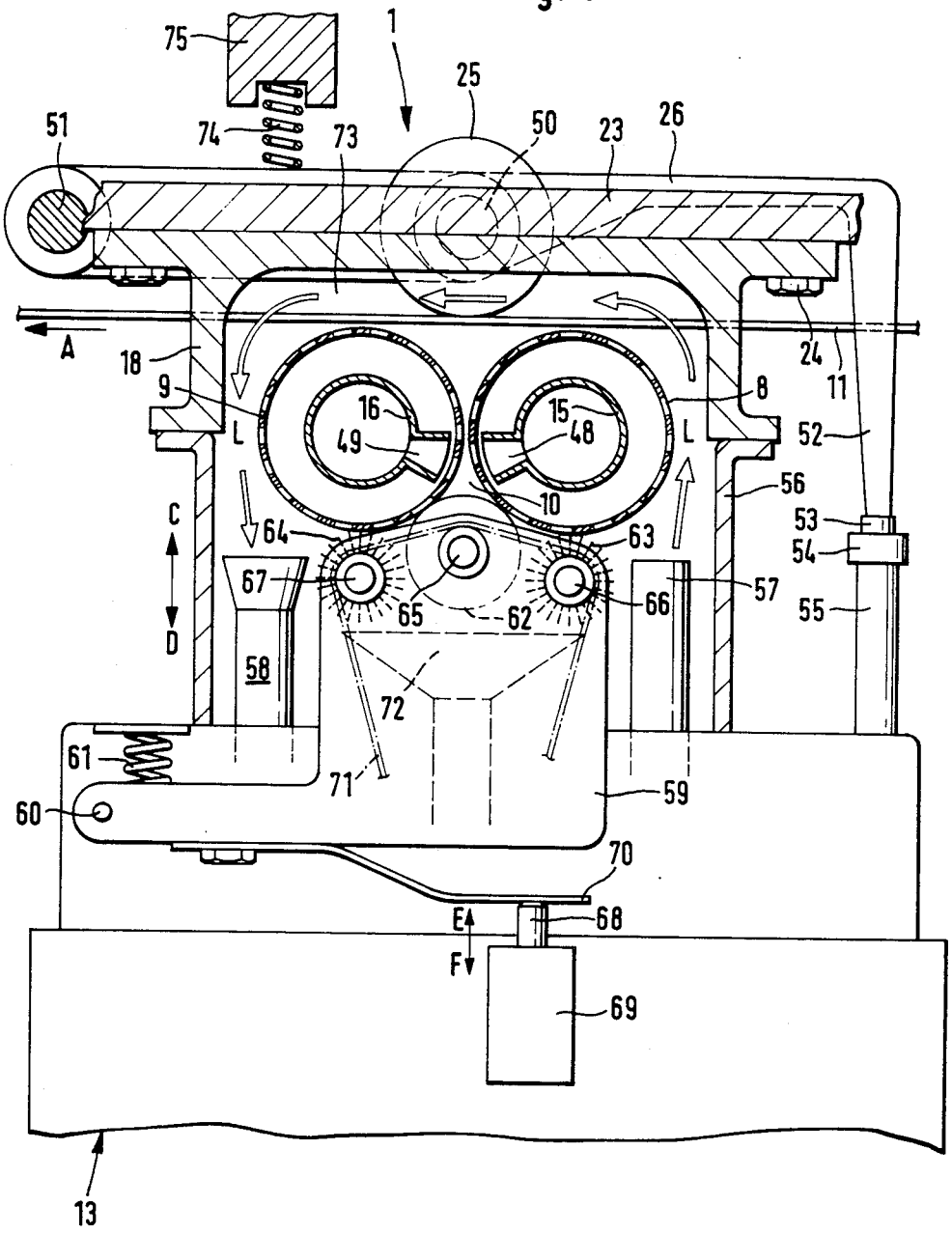
FIG. 3 is a horizontal sectional schematic view through a spinning unit which is also enlarged and shows a servicing apparatus constructed in accordance with preferred embodiments of the invention operating at said spinning unit.

Each spinning unit 1 has two friction rollers 8 and 9 that are arranged in parallel next to one another at a narrow distance and together form a wedge-shaped gap 10 serving as the yarn forming zone, to which the fibers of the sliver 3 opened up into individual fibers are fed and in which these fibers are twisted into a yarn 4 which is then withdrawn in longitudinal direction of the wedge-shaped gap 10 (direction of the Arrow B, FIG. 2). The rollers 8 and 9 are driven by a tangential belt drive driving the rollers 8 and 9 of all spinning units 1 of one side of the machine. The tangential belt drive contains a tangential belt 11 running along directly against the cover/shell surfaces of the rollers 8 and 9. The tangential belt 11 running through in the direction of the Arrow A in longitudinal direction of the machine, in the area of each spinning unit, is loaded with a tension pulley 25 disposed in the plane of the wedge-shaped gap 10, said tension pulley 25 pressing the tangential belt 11 against the cover surfaces of both rollers 8 and 9 (FIG. 3). The tension pulleys 25 of the spinning units 1, by means of shafts 50 extending in parallel to the rollers 8 and 9, are disposed on pivotal levers 26 that can be pivoted around pivotal shafts 51 in parallel to the shaft 50. A pressure spring 74 is applied to the pivotal lever 26, said pressure spring 74 supporting itself against a part 75 of the machine frame and pressing the tension pulley 25 against the tangential belt 11 with a predetermined force.

Within the rollers 8 and 9, tube-shaped suction inserts 15 and 16 are arranged which are open in the direction of the area of the wedge-shaped gap 10 via slot-shaped suction slots 48 and 49 delimited by webs projecting up to close to the inside walls of the shell surfaces of the rollers 8 and 9. The shells of the rollers 8 and 9 are supportably disposed on the tube-shaped suction inserts 15 and 16 by means of roller bearings 17. The suction inserts 15 and 16 themselves are fastened at a bearing housing 18 by means of tool holders 19 and screws 20. In the area of the tool holders 19, a vacuum duct 21 is connected to the suction inserts 15 and 16. The vacuum duct 21 is connected via a suction pipe 22 to a vacuum source that is not shown. The suction inserts 15 and 16 are closed on the front ends.

The suction air flow generated in the suction inserts 15 and 16 and aimed at the area of the wedge-shaped gap 10 supports the feeding of fibers taking place via the fiber feeding channel 40. In addition, the suction air flow is used to securely hold the forming yarn 10 in the wedge-shaped gap 10. The area of the wedge-shaped gap 10 is connected via the fiber feeding channel 40 with a feeding and opening device containing a feeding roller 27 which, in a manner that is not shown in detail, interacts with a feeding table that is resiliently pressed against it. The feeding roller 27 is disposed within a pipe 28 and, via a coupling 29 and a toothed wheel 30, engages with a toothed wheel 31 disposed on a shaft 32 running through in the longitudinal direction of the machine. In order to interrupt the feeding of the sliver 3, the coupling or clutch 29 is opened, especially by means of a yarn guard arranged in front of the withdrawal device 5 and responding to a yarn breakage. An opening roller 34 is arranged in parallel to the shaft of the feeding roller 27 which opening roller is housed in an opening roller housing 33. The opening roller housing 33 has a sleeve-shaped projection 35 by means of which it is fitted onto the pipe 28 of the feeding roller 27. The opening roller 34 is arranged on a shaft 37 projecting out of the opening roller housing 33 and driven by a tangential belt 38 running through in the longitudinal direction of the machine. In the direction of the operator's side, the area of the opening roller 34 is covered with a detachable lid 39.

The fiber feeding channel 40 is divided in its longitudinal direction. The first part 41 of the fiber feeding channel 40 is located in the opening roller housing 33. It is continued by a part 42 of a partial housing 43 containing a mouth 44 which, at a narrow distance, is opposite the wedge-shaped gap 10. The partial housing 43 is disposed at a holder 46 of the machine frame so that it can be pivoted around a shaft 45 extending in the longitudinal direction of the machine so that the partial housing can be swivelled into the dash-dotted position 47 so that the spinning unit 1 is opened and the rollers 8 and 9 are exposed. As shown especially in FIG. 2, the feeding and opening device located below the rollers 8 and 9 is arranged in such a way that the fiber feeding duct 40 extends in a straight line and at an acute angle with respect to the shafts of the rollers 8 and 9 in upward direction. The mouth 44 forms the so-called scatter zone or yarn forming zone over which the fibers are distributed when they are fed to the wedge-shaped gap 10.

As shown especially in FIG. 3, the roller bearing housing 18 has a housing side covering the rear side of the rollers 8 and 9, i.e. the area located opposite the fiber feeding duct 40. The roller bearing housing 18 itself is fastened at a support 23 of the machine frame by means of fastening screws 24. The roller bearing housing 18 has webs extending laterally next to the rollers 8 and 9 and in longitudinal direction and projecting approximately into the plane placed through the shafts of both rollers 8 and 9. After the spinning unit was opened by pivoting away the partial housing 43, the servicing apparatus 13 applies a pot-shaped screen 56 to these webs of the roller bearing housing 18 in the directin of Arrow C. within the pot-shaped screen 56, a suction nozzle 58 and a blowing nozzle 57 are arranged. The blowing nozzle 57, which is slot-shaped in the longitudinal direction of the roller 8, is aimed at the gap between the roller bearing housing 18 and the roller 8. The suction nozzle 58, which is also constructed to be slot-shaped and extends in the longitudinal direction of the roller 9, is disposed opposite the gap between the roller 9 and the edge of the roller bearing housing 18. By simultaneously switching on the blowing nozzle 57 and the suction nozzle 58, an air flow L is produced in the flow duct 73 formed by the rollers 8 and 9 and the roller bearing housing 18, said air flow L being used for detaching and removing dirt, such as flying fibers or fibers or similar substances, deposited in this area.

It is advantageous according to certain preferred embodiments to interrupt the drive of the rollers 8 and 9 during the cleaning process by moving away the tension pulley 25 from the rollers 8 and 9, by means of which the tangential belt 11 is detached from the shell surfaces of the rollers 8 and 9. For this purpose, the pivotal lever 26 is provided with an arm 52 projecting to the operator's side of the spinning unit 1, said arm 52, with a thrust piece 53, being disposed opposite a thrust piece 54 of a rod 55 that can be moved out of the servicing apparatus 13. It is advantageous for this cleaning to switch off the effect of the suction inserts 15 and 16. For this purpose, for example, a valve arranged in the vacumm pipe 22 is actuated by the servicing apparatus 13. An electromagnetically operable valve may, for example, be provided that can be actuated by a switch arranged in the pivotal area of the pivotal lever 26 in especially preferred embodiments.

The servicing apparatus 13 is also provided with an auxiliary drive in the form of a friction wheel 62 which is applied to the shell surfaces of both rollers 8 and 9 in the area of the wedge-shaped gap 10. The friction wheel 62 is located in a component 59 that can be pivoted against the pressure of a spring 61 around a shaft 60. The component 59, in a manner that is not shown in further detail, is equipped with an electric driving motor driving the friction wheel 62 via a toothed belt 71. The toothed belt 71 also loops around cleaning brushes 63 and 64 which are also arranged in the component 59 and are applied respectively to one of the rollers 8 and 9 during cleaning. The cleaning brushes 63 and 64 are disposed on shafts 66 and 67 that are parallel to the shafts of the rollers 8 and 9 and extend in the axial direction at least over the area of the yarn forming zone, i.e., the length of the mouth 44 of the fiber feeding channel 40 (looking in the direction of the wedge-shaped gap 10). A suction nozzle 72 is assigned to the cleaning brushes 63 and 64, the mouth of said suction nozzle 72 extending along the surface lines of the cleaning brushes 63 and 64. The dirt and deposits detached by the cleaning brushes 63 and 64 from the perforated cover surfaces of the rollers 8 and 9 are immediately sucked away by the suction nozzle 72. It is also contemplated by the invention to provide separate drives for the friction wheel 62 as well as for the cleaning brushes 63 and 64 in other embodiments. The application of the component 59 is effected via a control element 69 containing a piston 68 that can be moved in and out in the direction of the Arrows E and F, said piston 68 being applied to the component 59 via a leaf spring 70.

As a modification of the embodiment according to FIG. 2, it may also be provided that coaxially to the friction wheel 62, only one cleaning brush is arranged which then in the area of the wedge-shaped gap 10, is applied to both rollers 8 and 9. The friction wheel 62 will then be arranged in such a way that, in the area facing away from the withdrawal direction below the mouth 44 of the fiber feeding channel 40, it is applied to the cover surfaces of the rollers 8 and 9, while the cleaning bursh covers and brushes of the area located above it.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An open-end friction spinning machine having at least one spinning unit containing:

two friction rollers that are arranged next to one another to form a wedge-shaped yarn forming gap serving as a yarn forming zone, a housing side means disposed adjacent the friction rollers at the side thereof opposite the yarn-forming gap, and periodically switchable means for producing an air flow between the housing side means and the friction rollers.

2. An open-end friction spinning machine according to claim 1, wherein the switchable means for producing an air flow between the housing side and the friction rollers are housed in a servicing apparatus that can be moved along the spinning machine, said switchable means being selectively operatively applied at respective individual spinning units of the spinning machine.

3. An open-end friction spinning machine according to claim 2, wherein the servicing apparatus is equipped with a pot-shaped screen that can be applied to the edges of the housing side means, the switchable means for producing the air flow being arranged within this screen.

4. An open-end friction spinning machine according to claim 1, wherein the switchable means includes a blowing nozzle means which can be applied to a gap between the edge of the housing side means and one of the rollers and a suction nozzle means which can be applied to a gap between the edge of the housing side and the other friction roller.

5. An open-end friction spinning machine according to claim 3, wherein the switchable means includes a blowing nozzle means which can be applied to a gap between the edge of the housing side means and one of the rollers and a suction nozzle means which can be applied to a gap between the edge of the housing side and the other friction roller.

6. An open-end friction spinning machine according to claim 4, wherein the blowing nozzle means and the suction nozzle means have a slot-shaped form and extend at least over the length of the yarn forming zone.

7. An open-end friction spinning machine according to claim 5, wherein the blowing nozzle means and the suction nozzle means have a slot-shaped form and extend at least over the length of the yarn forming zone.

8. An open-end friction spinning machine according to claim 2, wherein the area of the wedge-shaped gap of the spinning unit serving as the yarn forming zone is provided with a removable partial housing, and wherein the servicing apparatus is provided with means for removing the partial housing and with the switchable means for producing the air flow.

9. An open-end friction spinning machine according to claim 1, wherein the friction rollers project over the housing side means in the direction that is opposite the yarn withdrawal direction, and wherein in this area, a tangential belt drive is applied to the cover surfaces of the friction rollers.

10. An open-end friction spinning machine according to claim 4, wherein the friction rollers project over the housing side means in the direction that is opposite the yarn withdrawal direction, and wherein in this area, a tangential belt drive is applied to the cover surfaces of the friction rollers.

11. An open-end friction spinning machine according to claim 2, wherein the servicing apparatus is equipped with an auxiliary drive that can be applied to the friction rollers of the spinning units.

12. An open-end friction spinning machine according to claim 3, wherein the servicing apparatus is equipped with an auxiliary drive that can be applied to the friction rollers of the spinning units.

13. An open-end friction spinning machine according to claim 2, wherein the servicing apparatus is equipped with at least one cleaning element that can be applied to the shell surfaces of the rollers.

14. An open-end friction spinning machine according to claim 3, wherein the servicing apparatus is equipped with at least one cleaning element that can be applied to the shell surfaces of the rollers.

15. An open-end friction spinning machine according to claim 13, wherein separate suction nozzles are assigned to the cleaning element or elements.

16. An open-end friction spinning machine having at least one spinning unit containing:

drivable friction surface means defining a yarn forming zone, a housing side means disposed adjacent the friction surface means at the side thereof opposite the yarn forming zone, and periodically switchable means for producing an air flow between the housing side means and the friction surface means.

17. An open-end friction spinning machine according to claim 16, wherein the drivable friction surface means comprises at least one rotatable friction roller.

18. An open-end friction spinning machine according to claim 16, wherein the switchable means are housed in a servicing apparatus that can be moved along the spinning machine, said switchable means being selectively operatively applied at respective individual spinning units of the spinning machine.

19. An open-end friction spinning machine according to claim 16, wherein the switchable means includes a blowing nozzle means which can be applied to a gap between one edge of the housing side means and said friction surface and a suction nozzle means which can be applied to a gap between the other edge of the housing side and said friction surface.

20. An open-end friction spinning machine according to claim 18, wherein the servicing apparatus is equipped with an auxiliary drive that can be applied to the friction surface means.

21. An open-end friction spinning machine according to claim 20, wherein the servicing apparatus is equipped with at least one cleaning element that can be applied to the friction surface means.

22. An open-end friction spinning machine according to claim 21, wherein separate suction nozzles are assigned to the cleaning element or elements.

23. An open-end friction spinning machine according to claim 19, wherein the area of the yarn forming zone is provided with a removable partial housing, and wherein the servicing apparatus is provided with means for removing the partial housing and with the switchable means for producing the air flow.

* * * * *